United States Patent [19]

Weber

[11] Patent Number: 4,755,064

[45] Date of Patent: Jul. 5, 1988

[54] ISOTHERMIC PACKAGE

[76] Inventor: Jean-Pierre Weber, Ave. Gasparin, Chene-Bourgeries, Switzerland

[21] Appl. No.: 887,836

[22] PCT Filed: Oct. 30, 1984

[86] PCT No.: PCT/CH84/00174

§ 371 Date: Aug. 26, 1986

§ 102(e) Date: Aug. 26, 1986

[87] PCT Pub. No.: WO86/02619

PCT Pub. Date: May 9, 1986

[51] Int. Cl.[4] ..... B65D 30/08

[52] U.S. Cl. ..... 383/110; 383/109; 383/113

[58] Field of Search ..... 383/110, 109, 113, 901; 206/484, 484.2, 492; 62/530

[56] References Cited

U.S. PATENT DOCUMENTS

| | | | |
|---|---|---|---|
| 1,942,917 | 1/1934 | D'Este et al. | 383/110 |
| 1,993,394 | 3/1935 | Bangs et al. | 383/110 |
| 2,430,459 | 11/1947 | Farrell et al. | 229/87 F |
| 3,082,585 | 3/1963 | Waters | 383/109 |
| 3,891,138 | 6/1975 | Glas | 206/484 |
| 4,147,291 | 4/1979 | Akao et al. | 383/113 |
| 4,462,224 | 7/1984 | Dunshee et al. | 62/530 |
| 4,528,694 | 7/1985 | Skovgaard | 383/110 |
| 4,662,527 | 5/1981 | Moretti | 206/484 |

FOREIGN PATENT DOCUMENTS

| | | | |
|---|---|---|---|
| 3151701 | 7/1983 | Fed. Rep. of Germany | 383/109 |

*Primary Examiner*—Willis Little

*Attorney, Agent, or Firm*—Robert E. Burns; Emmanuel J. Lobato

[57] ABSTRACT

The isothermic package is comprised of a flat and flexible envelope (10) of which the two walls (11, 12) are welded along three sides so as to provide an opening (13) for introducing and withdrawing the product (P) to be kept warm or cold during its transportation. The walls (11, 12) are each comprised of two isothermic sheets (14, 15) which delimit therebetween a spaced (16, 17, 18) filled with a gas having a low heat transmission power.

4 Claims, 2 Drawing Sheets

ISOTHERMIC PACKAGE

There are known isothermic packages which permit maintaining during a certain interval of time hot or cold alimintary products at an acceptable temperature.

These packages are generally used for transporting a hot or cold product from the place where it is purchased to the place where it is consumed or the place (cold storage, refrigerator, etc.) where it is kept or stocked before being consumed.

Unfortunately, these packages do not offer a satisfactory thermic barrier when the ambient temperatures go beyond the habitual norm or if the duration of the transport is relatively long.

In this case, the temperature of the product attains during the transport a critical temperature by reason of which its appearance, its qualities, its taste are altered in the manner that it becomes unfit for consumption.

The present invention has for its object an isothermic package which permits at least doubling, all conditions and proportions being the same, the duration during which the product is maintained at an acceptable temperature, that is to say situated above or below according to the case of the critical temperature.

This package which is constituted by an envelope provided with an opening for the introduction and removal of the product is characterized by the fact that the walls of the envelope are each formed of a plurality of sheets defining between them at least one closed space filled with fluid. The annexed drawing represents schematically and by way of nonlimiting example a form of execution of the object of the invention and illustrates a process of fabrication of this form of execution of the package according to the invention.

Figure 1:
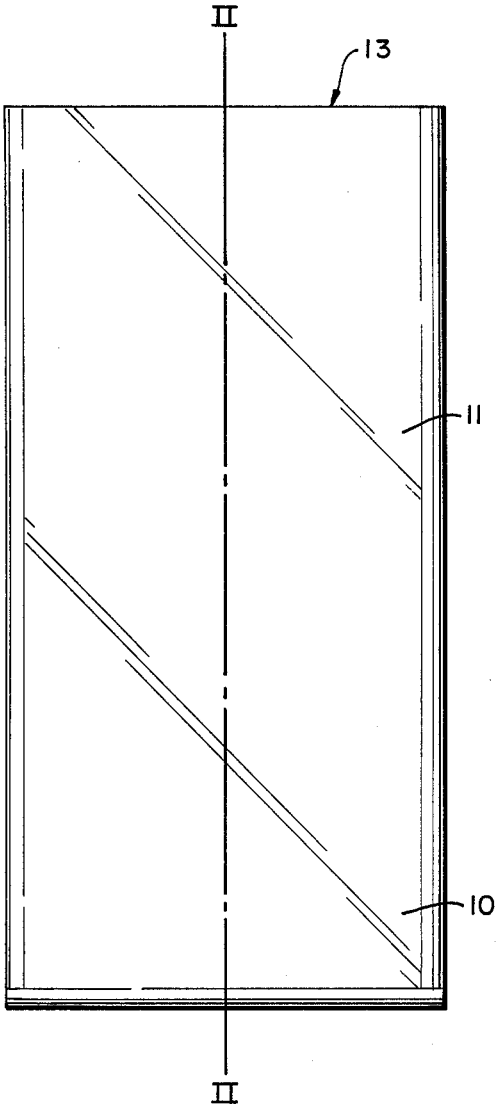
FIG. 1 is a plan view of the empty package.
Figure 2:
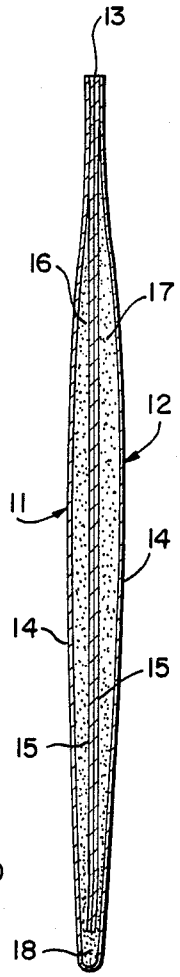
FIG. 2 is a section along the line II—II of FIG. 1.
Figure 3:
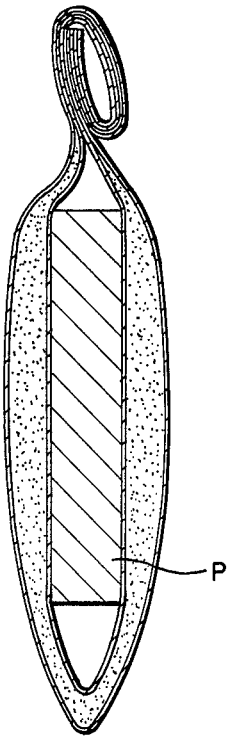
FIG. 3 is a section similar to that of FIG. 2 of the package containing a product.

The package shown in FIGS. 1 to 4 is constituted by a flat souple envelope 10 of rectangular form of which the two walls 11 and 12 are welded on three sides in a manner to provide an opening 13 for the introduction and removal of the product.

Each of the walls 11 and 12 is composed of two sheets 14,15 which confine between them pockets 16 and 17 filled with air or a gas having low power of transmission of heat and a pressure slightly greater than atmospheric pressure.

The pockets 16 and 17 are connected with one another at a side opposite the opening 13 by a passage 18.

The sheets 14 and 15 which are found in commerce are constituted by a layer of plastic material 19 and by a metalized layer 20.

The product to be transported is introduced into the package into the package through the opening 13 then the envelope is rolled beginning with this opening until the product is well held, then the rolled part is fixed with one or two clips possibly with closure means incorporated or not in the package, these means been given a pretensioned disposition.

In the course of rolling, the thickness of the layer of air is increased more or less according to the volume of the product.

The thermic barrier formed by this layer of air and by the double thickness of the walls themselves, constituted by the isothermic sheets permits maintaining during several hours temperatures in the neighborhood of the temperatures of conservation of the product transported or stocked.

It is remarked that by virtue of the passage 18, the continuity of this thermic barrier is not interrupted at the bottom of the package. This is particularly important due to the fact that the bottom of known isothermic packages is generally the place where the heat exchanges—from the exterior to the interior or inversely—are greatest.

In a variant, the air contained in the spaces 16, 17 can be replaced by a liquid, advantageously, a liquid called refrigerant analogous to the liquid utilized in souple "ColdHo Pack" pockets of 3M of which the congealing point is of the order of −18° C.

The isothermic packages thus realized can be stocked in refrigerated enclosures before being used in a manner to permit sensibly, prolonging the duration during which the product is conserved at an acceptable temperature.

The process of fabrication of the package illustrated in FIGS. 5 to 9 is especially economical.

Figure 4:
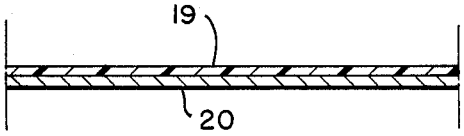
FIG. 4 is a view of a detail.
Figure 5:
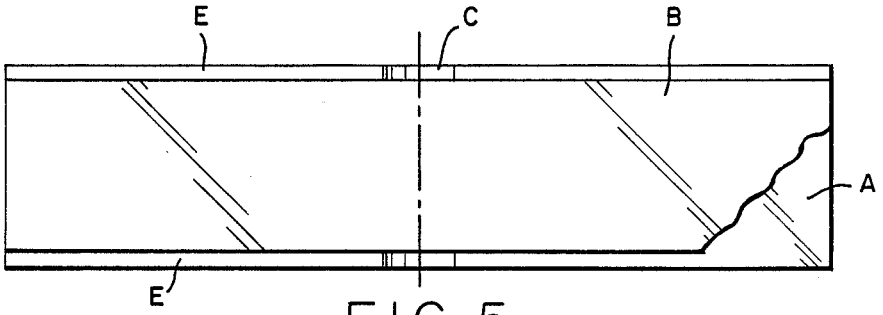
FIGS. 5 to 9 illustrate the several operations of the process of fabrication of this package.
Figure 6:
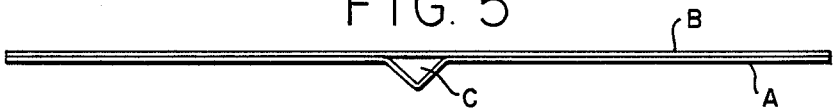
Figure 7:
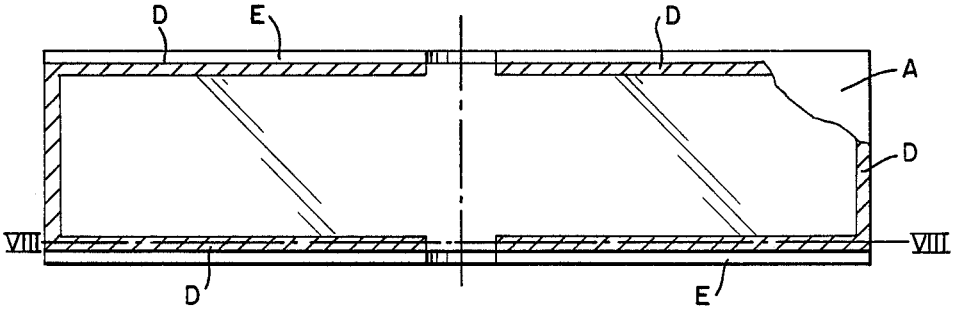

The process consists starting with two rectangular sheets of the type shown in FIG. 4 of which one A is longer and wider than the other B (FIG. 5) superposing the two sheet, plastic layer against plastic layer and making their small sides coincide and forming an undulation C to absorb the excess length of the sheet A (FIG. 6) heat welding the two sheets along the bands D FIG. 7, pressing down one against the other the two portions of the two sheets thus welded (FIG. 8) heat-welding the corresponding borders E of the sheet A, inflating during this last operation air or an appropriate gas in the pockets 16 and 18 during formation.

Figure 8:
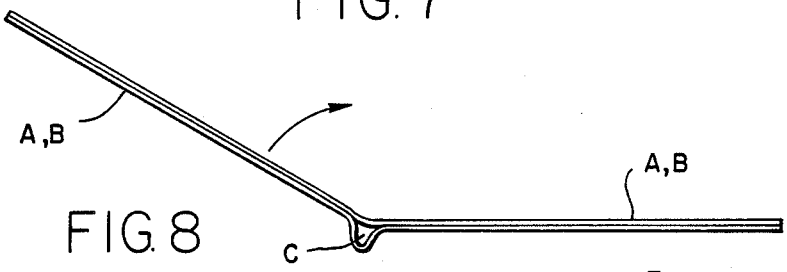
Figure 9:
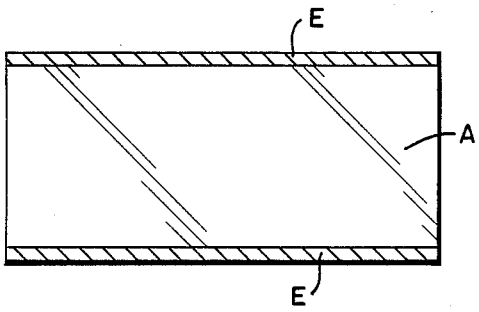

In a variant of this process, the operations of welding (FIGS. 7 and 9) can be combined in a single operation after having pressed together in suitable positions the two sheets A and B (FIG. 8).

I claim:

1. An isothermic package comprising two rectangular sheets of flexible plastic material, namely an inner sheet and an outer sheet, said outer sheet being longer than said inner sheet to provide excess material in said outer sheet, said sheets being sealed together at their margins with fluid trapped between them to form a hollow double wall structure, said double wall structure being folded along a transverse line to bring opposite ends together and being sealed together along opposite side edges to form a pocket for receiving an item to be packaged, said excess material of said outer sheet providing an undulation at the fold to provide communication between opposite hollow walls of said package, and said opposite ends of said double walls being superposed and separable to provide an entry way for an item into said package and being foldable or rollable to close said entryway and to increase pressure of fluid in said hollow double walls of said package.

2. An isothermic package according to claim 1, in which a surface of said sheets of plastic material is metalized.

3. An isothermic package according to claim 1, in which said fluid is a gas.

4. An isothermic package according to claim 1 in which said fluid is liquid refrigerant.

* * * * *